United States Patent [19]

Fox

[11] Patent Number: 5,062,358

[45] Date of Patent: Nov. 5, 1991

[54] BALE EJECTOR FOR A TRASH COMPACTOR

[75] Inventor: Anthony Fox, Bloomington, Minn.

[73] Assignee: Marcella M. Fox, Bloomington, Minn.

[21] Appl. No.: 606,907

[22] Filed: Oct. 31, 1990

Related U.S. Application Data

[63] Continuation-in-part of Ser. No. 405,272, Sep. 11, 1989, abandoned, which is a continuation-in-part of Ser. No. 357,091, May 25, 1989, abandoned.

[51] Int. Cl.[5] ..... B30B 15/32

[52] U.S. Cl. ..... 100/218; 100/229 A; 100/245; 100/255; 242/107.4 R

[58] Field of Search ..... 100/218, 229 A, 245, 100/246, 255, 3; 242/107.4 R

[56] References Cited

U.S. PATENT DOCUMENTS

| | | | |
|---|---|---|---|
| 36,525 | 9/1862 | Penniston | 100/218 X |
| 314,523 | 3/1885 | Duval | 100/218 |
| 337,582 | 3/1886 | Hildreth | 242/107.4 R |
| 1,040,396 | 10/1912 | Paal | 100/218 |
| 3,392,477 | 7/1968 | Haugen, Jr. | 242/107.4 R X |
| 3,851,577 | 12/1974 | Newcom et al. | 100/218 |
| 3,944,163 | 3/1976 | Hayashi et al. | 242/107.4 R |
| 3,945,313 | 3/1976 | Komberec et al. | 100/218 X |
| 4,182,236 | 1/1980 | Greer | 100/218 X |
| 4,777,873 | 10/1988 | Zimmer | 100/218 |

FOREIGN PATENT DOCUMENTS

| | | | |
|---|---|---|---|
| 198138 | 8/1967 | U.S.S.R. | 100/218 |
| 683927 | 9/1979 | U.S.S.R. | 100/218 |
| 1189690 | 11/1985 | U.S.S.R. | 100/218 |

*Primary Examiner*—Harvey C. Hornsby
*Assistant Examiner*—Stephen F. Gerrity
*Attorney, Agent, or Firm*—Haugen and Nikolai

[57] ABSTRACT

A built-in bale ejector for use in a trash compactor comprises an elongated band which is fastened at one end to the floor portion of the compactor cabinet at a front edge thereof and which passes between the floor and a box in which the refuse is to be compacted and then up the inside rear wall of the compactor to a predetermined height. The compactor includes a vertically movable compaction plate which can be driven in reciprocal fashion downward into the box to compress the refuse therein and upward to a "ready" position. When it is desired to eject a filled box, a spring-loaded take-up reel mechanism coupled to the compaction plate can be latched against rotation by a locking mechanism. When so locked, the return stroke of the compaction plate pulls the band tight and thus urges the box filled with the compacted trash to be ejected out through the door opening of the compactor cabinet. In an alternative embodiment, the entire spring wheel assembly is replaced with a high torque motor whose output shaft drives a cylindrical take-up reel on which the band may be wound.

12 Claims, 4 Drawing Sheets

BALE EJECTOR FOR A TRASH COMPACTOR

CROSS-REFERENCE TO RELATED APPLICATIONS

This application is a continuation-in-part of application Ser. No. 07/405,272, filed Sept. 11, 1989 (now abandoned). That application was itself a continuation-in-part of application Ser. No. 07/357,091, filed May 25, 1989 (now abandoned).

BACKGROUND OF THE INVENTION

I. Field of the Invention

This invention relates generally to trash compacting apparatus, and more particularly to an improved arrangement for facilitating the ejection of a box laden with compacted trash from the interior of the compaction chamber of a trash compactor.

II. Discussion of the Prior Art

Various types of refuse compactors are known in the art. A typical one is disclosed in the Fox U.S. Pat. No. 4,152,035 and it is seen to comprise an upright cabinet of generally rectangular cross-section having a floor, a top and three mutually perpendicular vertically extending panels comprising a rear and two sides. The two sides are parallel and spaced apart and at the front edge thereof define an opening. A door panel is hinged along a vertical axis at one of the front edges allowing access to the interior of the compaction chamber. The cabinet can be arbitrarily considered as being divided into three compartments, namely, a machinery compartment, a trash loading compartment and the compaction compartment. The machinery compartment is at the top of the cabinet and contains the mechanism for reciprocally driving the compaction plate from its elevated or upper location, through the intermediate trash loading compartment and into the compaction compartment. The drive mechanism may typically comprise an electric motor driving a hydraulic pump with the hydraulic fluid being applied through appropriate valving to a hydraulic ram. The compaction plate is attached to the lower end of the hydraulic ram.

It is also known in the art to provide a box or similar receptacle in the compaction chamber so that when the trash to be compacted is dropped into the trash loading chute it falls into the box. When reaching a predetermined depth, the operator may cycle the compaction machinery causing the hydraulic ram to push the compaction plate into the box and tightly compress the refuse therein. Being an open-top receptacle, there is a tendency for the side walls of the receptacle to swell or bulge as the trash is compacted. This swelling may cause the box to bind against the side and rear walls of the compaction chamber, making it difficult for the operator to remove a box filled with the compacted refuse.

Soviet Inventor's Certificate 683,927 addresses this problem by disclosing a packeting press for waste bales including a press chamber, cross-bar, pressing plate and chain. The press chamber and pressing plate function as typical for the industry to compact waste. The pressing plate is attached to a cross-bar. A rack runs up the back wall, onto which the cross-bar and chain are attached. A locking mechanism in the form of a catch that is wedged underneath a tooth in the rack serves to affix the chain to the compaction plate. This entire assembly is raised in order to eject a bale. As the rack lifts, tension increases on the chain, since its lower-end is affixed to the front of the compaction chamber near the door. Increasing tension on the chain lifts the bale until the chain is pulled to its full length. At this point, the bale can be rolled out of the rest of the chamber.

This arrangement has several problems. The chain has a tendency to saw into the bale. Also, both the chain and the compaction plate hinge on the rack, producing a great amount of torque as the assembly is moved upward carrying along the full weight of the bale. Finally, the ratchet mechanism utilized is not as efficient as the mechanism of the present invention.

OBJECTS

It is accordingly a principal object of the present invention to provide an improved arrangement for facilitating the ejection of a filled trash receptacle from the compaction compartment of a refuse compactor.

Another object of the invention is to provide a bale ejector which is low in cost, effective in use and simple to operate.

Yet another object of the invention is to provide a mechanism for facilitating the ejection of a receptacle filled with compacted trash from the compaction chamber of a refuse compactor which uses the hydraulic power for the compaction plate to provide the ejection force.

Still another object of the invention is to provide a motor-driven or spring take-up reel coupled to an elongated flexible strap for providing the trash receptacle ejection force.

SUMMARY OF THE INVENTION

The foregoing features and advantages of the invention are achieved by providing an elongated flexible band having first and second ends. In accordance with a first embodiment, the first end of the flexible strap is secured to the front edge of the cabinet floor and the band extends along the floor to the rear of the cabinet and then up the rear wall. The upper end of the band is affixed to a spring take-up reel. When a refuse container is placed in the compaction chamber, it rests upon the portion of the band that parallels the floor and sandwiches the portion of the band which extends up the rear wall of the cabinet. When a lock wheel on the spring take-up reel is not engaged, the compaction plate is free to move up and down without tensioning the belt.

When the box becomes filled with compacted trash, the refuse container may become deformed and it becomes difficult to manually extract the filled container or cube out through the open door. Since it rests on the strap, tension on the strap will assist in extraction.

Once the refuse container or box has been filled, and with the door open, the operator may first engage the lock wheel and then depress the compactor's push-button safety switch to energize the motor driving the compaction plate until it is just above the top of the cube. The strap winds up on the spring take-up reel which effectively shortens its length. A locking mechanism may then be engaged with the lock wheel so the belt is kept at a fixed length as the compaction plate is raised, resulting in the belt lifting and rotating the cube out through the door opening. Release of the locking mechanism releases the spring loaded take-up reel so a new cube may be inserted into the compaction chamber on top of the belt. The reel free-wheels allowing the strap to wind and unwind from the reel as the compaction plate is raised and lowered to compact further refuse in advance of the next removal cycle.

Although a lock wheel mounted on the spring reel shaft and a mating lock rod with a handle are shown, alternative locking mechanisms are also possible. One alternative comprises a lock plate that may be shifted toward the open door to engage the lock wheel and maintain tension on the belt.

A further alternative is to mount an electric motor on the compactor wall external to the chamber. When engaged, the motor drives a reel that winds up the belt and ejects the bale.

The foregoing features and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
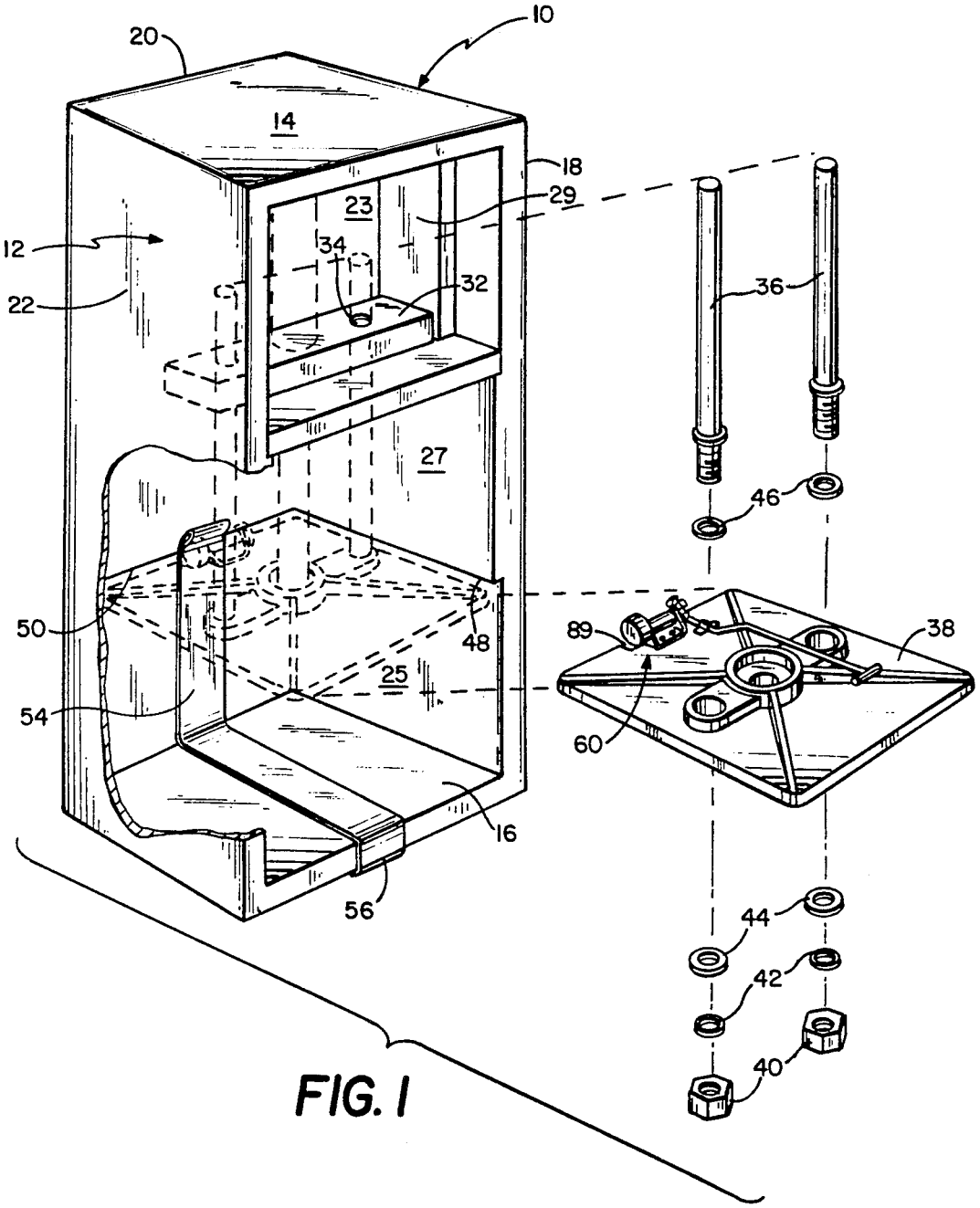
FIG. 1 is a blown-apart, partial perspective view with door removed and side panel partially broken away to show the interior construction thereof.
Figure 3A:
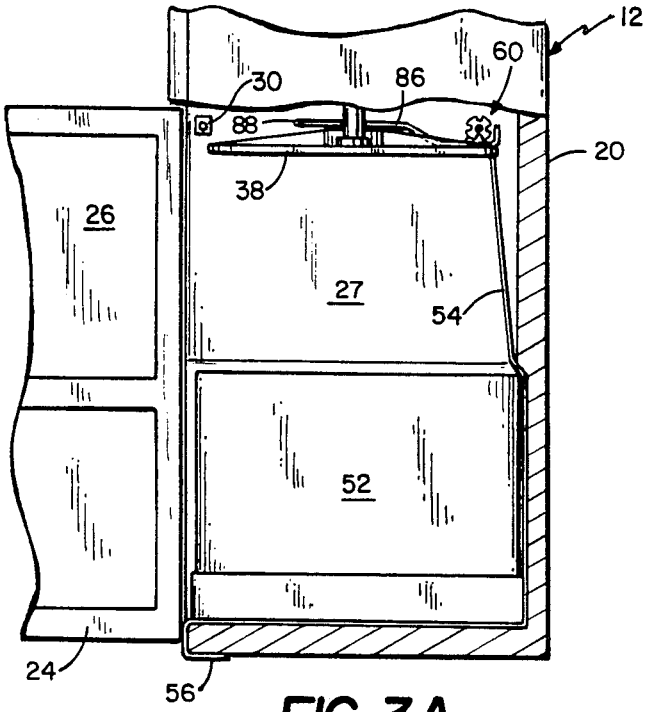
FIGS. 3A, 3B and 3C are a series of side elevations with the side panel partially broken away illustrating the sequencing of the compaction plate for effecting the box ejection.
Figure 3B:
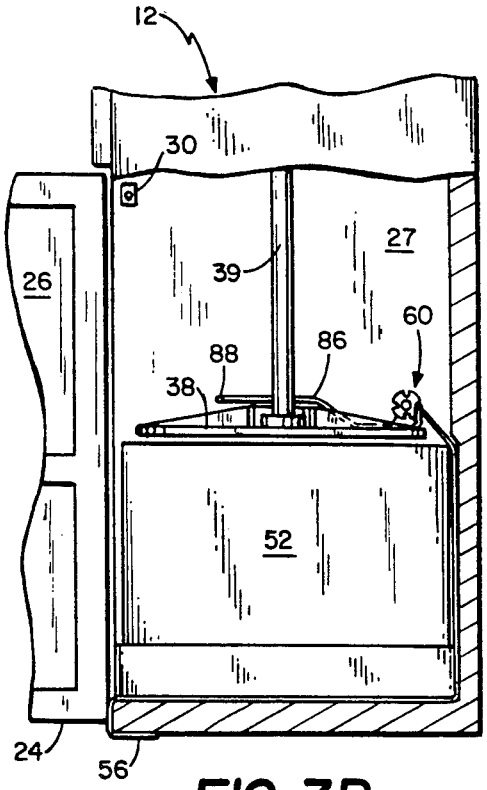
Figure 3C:
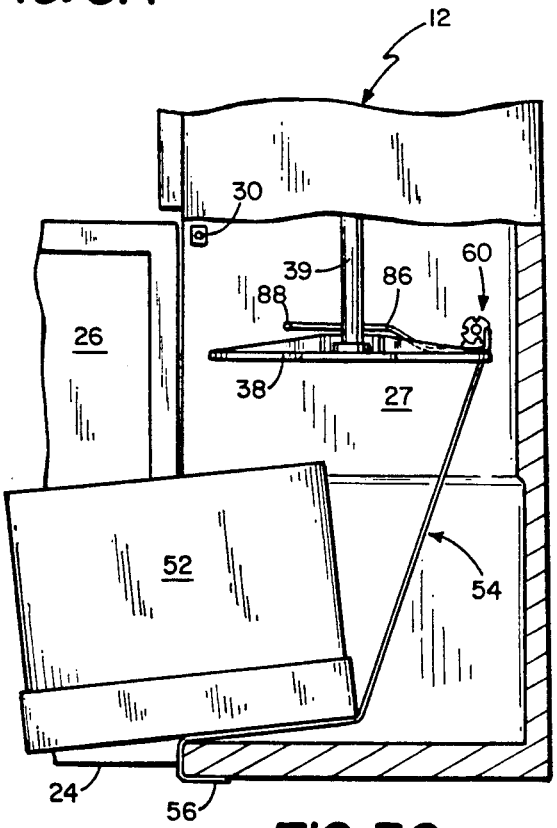

Referring first to FIG. 1, there is illustrated, generally, by numeral 10 a trash compactor incorporating the present invention. It is seen to include an upright cabinet 12 of rectangular cross-section and having a top member 14, a base or floor 16, and three mutually perpendicular side panels 18, 20 and 22, respectively. As shown in FIGS. 3A, 3B and 3C, the compactor cabinet also includes one or more doors as at 24 hinged for rotation about a vertical axis and, when closed, serving to cover the open front of the cabinet. The door 24 is not included in the view of FIG. 1 so that the interior features will be visible in solid line form.

The cabinet 12 may be considered as being divided into three functional compartments including an upper machine compartment 23, a lower compaction chamber 25 and an intermediate refuse loading compartment 27. Structural side frame members, as at 29, comprise welded steel channels extending vertically along opposed side panels 18 and 22. Extending between the frame members 29 is a bearing block 32 which is welded in place to provide increased rigidity to the cabinet frame as well as to house sleeve bearings 34 into which are fitted a pair of compaction plate guide rods 36. Attached to the lower end of the guide rods 36 is the compaction plate 38 itself. Nuts 40 and lock washers 42 secure the rods to the plate. Annular spacers 44 and 46 fit into recesses formed in the compaction plate for providing precise centering of the guide rods 36 relative to the sleeve bearings 34 in the bearing block 32.

Also missing from the view of FIG. 1 but shown partially in FIG. 3A through 3C is the hydraulic ram 39 for driving the compaction plate 38. It is disposed in the machinery compartment 23 along with an electric motor and a hydraulic pump. In this fashion, the compaction plate may be made to descend from an upper location proximate the underside of the bearing block 32 into the compaction chamber 25. Those desiring more information concerning the mechanical construction of the cabinet and the apparatus for driving the compaction plate 38 ar referred to the afore-referenced Fox U.S. Pat. No. 4,152,035, which is assigned to the assignee of the present invention.

With continued reference to FIG. 1 as well as to the side view in FIG. 3A, the side panels 18 and 22 are recessed slightly in the compaction chamber as indicated by the lines 48 and 50 in FIG. 1. This recess permits a box as at 52 (FIGS. 3A–C) to fit within the compaction chamber and with the vertical side edges of the box contained within the recess so as to be cleared by the compaction plate 38 as it is made to descend into the box to compact refuse dumped in it. The box 52 is not present in the view of FIG. 1 so that the ejection strap 54 can better be viewed. The strap is anchored at one end 56 to the base 16 of the compactor cabinet and first is routed over the base 16 and then vertically upward along the interior of the rear panel 20. The upper end of the band 54 passes along the rear panel and across the upper surface of the compactor plate 38 to a reel assembly, denoted generally as 60 which is mounted on the upper surface of the compaction plate. The reel assembly consists of a spring-loaded take-up reel and lock rod combination, shown in greater detail in FIG. 2.

Figure 2:
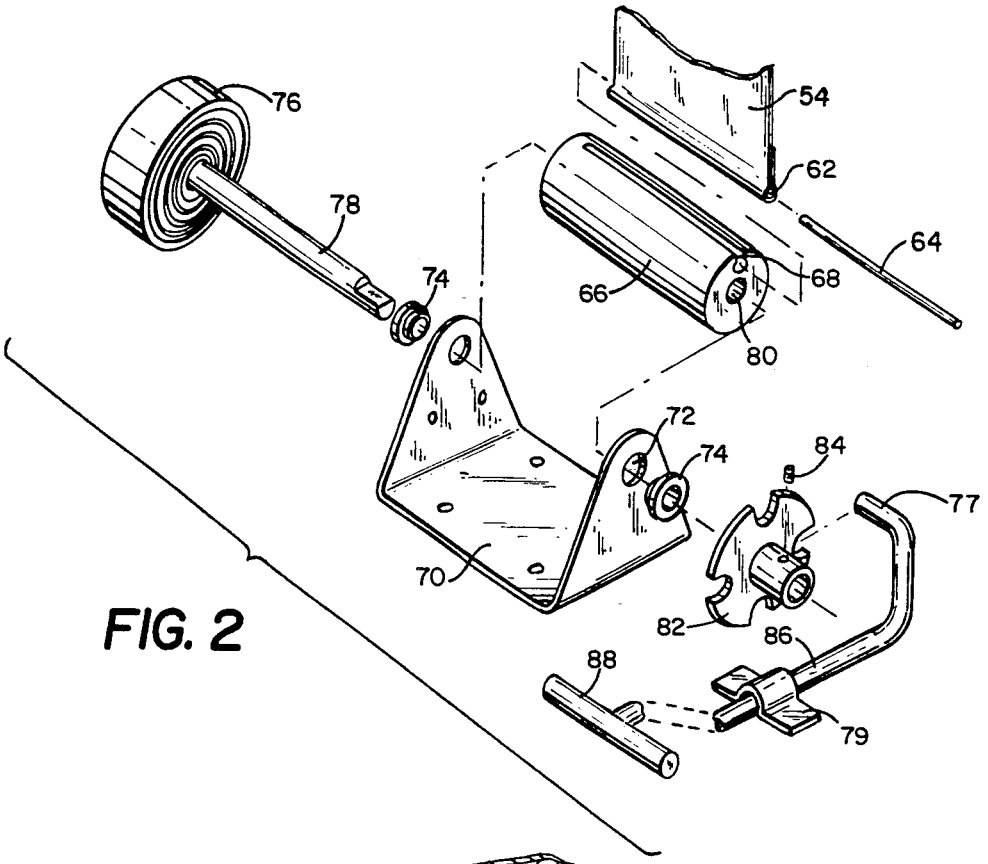
FIG. 2 is a blown-apart view of the components of the spring reel take-up and locking mechanisms.

The reel assembly 60 is shown disassembled in FIG. 2. The ejector strap 54 is fitted with a loop 62 at its uppermost end. The loop is of sufficient internal diameter to accommodate a retainer pin 64, yet still be able to fit into a slot 68 that is formed in a strap roll 66. This formulation permits the ejector strap 54 to be changed periodically, as necessary, by removing the retainer pin 64 and withdrawing the strap 54 from the slot 68 in the strap roll 66. The strap roll 66 is rotatably mounted on a bracket 70. With no limitation intended, this bracket 70 could be formed of 10-gauge galvanized steel and bolted or otherwise affixed to the upper surface of the compactor plate 38. Two sides of the bracket 70 are turned up perpendicular to the surface of the compactor plate. Each of these two sides has a bore 72 to receive a bushing 74. A coil spring 76 has one end affixed to the bracket 70 and its other end affixed to a shaft 78 about which the coil spring 76 is wound. The shaft is long enough to span the gap from one leg of the bracket 70 to the other when fed through the bushings 74. The strap roll 66 is fitted with a bore 80 which extends the length of the strap roll. This bore receives and is releasably attached to the shaft 78 of the spring-loaded take-up reel assembly 60. This shaft may be formed from a ½-inch diameter steel rod, but those familiar with the art will recognize that other suitable materials are available. The portion of the shaft which passes through the bore in the strap roll is proportioned to fit into a lock wheel 82 which is affixed to the shaft by a set screw 84. Notches are cut into the circumference of the lock wheel 82 at regularly spaced locations. Each notch is of adequate diameter to accept a portion of a lock rod 86 therein. The lock rod 86 is maintained parallel to the upper surface of the compactor plate 38 by means of a slide bracket 79 affixed to this surface. The slide bracket 79, when affixed to the surface of the compactor plate 38, forms a sleeve with sufficient clearance to permit the lock rod 86 to slide, yet only allows a minimum of play sufficient to permit grasping of the pull handle 88. The other end of the lock rod 86 is bent so as to extend perpendicular to the compactor plate 38 at about ⅓ of the length of the rod. This end of the lock rod 86 is again bent so as to have a short segment 77 that runs parallel to the compactor plate, at a point sufficient to engage one of the notches in the lock wheel 82. When the door 26 is closed, the lock rod 86 is forced toward the rear panel so this segment 77 is disengaged from the notches in lock wheel 82 during normal operation of the compaction mechanism.

In general, when it is desired to eject a compacted bale, the lower door is opened and the pull handle 88 is grasped and pulled in the forward direction. This causes the entire lock rod assembly 86 to advance toward a notch in the lock wheel 82 and to become engaged therein. While maintaining this position, and with the door 24 open, the hydraulic ram 39 is retracted using safety switch 30 (FIG. 3) so that the compactor plate 38 moves toward the top 14 of the compactor. Because of the engagement of the lock rod segment 79 with a notch in the wheel 82, as described in greater detail hereinafter, the shaft is not free to rotate and play out additional length of strap from its reel. Hence, when the compactor plate 38 lifts, it pulls the ejector belt 54 taut and forces the box 52 out the door 24.

Reference is next made to the sequence of views shown in FIGS. 3A, 3B and 3C. In each instance, there is shown a partial side view of the cabinet 12. The door 24 is shown in its open disposition relative to the front of the compactor cabinet. In FIG. 3A, the door 24 is open, permitting access to the entire compartment. Inset into the face of door 24 is a smaller trash loading door 26, which permits access to intermediate refuse loading compartment 27 (FIG. 1). Located just inside this door on the side panel 22 (FIG. 1) is a manual safety switch 30. The compactor plate 38 may be raised during normal operation of the hydraulic ram 39 or it may be raised by manually depressing the safety switch 30 with either door 24 or 26 open. As the compactor plate 38 is raised, the spring-loaded take-up reel 60 slowly plays out the ejector belt 54 so that it is taut, but does not disturb the box 52. As the compactor plate moves down toward the box 52, the spring biased take-up reel 60 slowly winds the ejector belt 54 to maintain tautness.

Next, with reference to FIG. 3B, the operator may manually depress the safety switch 30 to cycle the compaction plate 38 so that it first moves downward through the trash loading compartment 28 and into the upper open top of the box 52. The compaction plate enters the box 52 and crushes the refuse deposited therein. As the box 52 becomes filled with compacted refuse, there is a tendency for its side walls to bulge outward wedging the box against the interior walls of the compaction chamber. This makes it difficult for an operator to merely open the door and pull the box 52 out through it.

When removal of the box 52 is desired, the compactor plate 38 is positioned near the top of this box, as in FIG. 3B. The operator reaches into the unit and grasps the pull handle 88. The handle is pulled toward the open door 24 or 26 so as to engage the lock wheel 82. This prohibits the spring take-up reel 60 from releasing the ejector belt 54.

The hydraulic ram 39 and ejector belt 54 work together as shown in FIG. 3C. As the hydraulic ram 39 is moved toward the top 14 of the unit 10, increasing tension on the ejector belt 54 pushes at the lower rear corner of the box 52 and dislodges it from its rest position in compartment 25. As the compaction plate rises, the band increasingly lifts the rear bottom edge of the box 52 and urges the box out through the door opening.

It will be understood that when the door 24 is closed, the lock rod 86 must be pushed to the rear and thus is disengaged from the lock wheel 82 so the shaft is free to turn. This allows the compaction plate 38 to be cycled up and down, compacting trash dumped into the box 52 through the trash loading door 26 set in the door 24 with only modest tension on the band 54.

The band 54 may be made from spring steel or from nylon webbing. While a lock wheel 82 and lock rod 86 are shown, those skilled in the art may devise other types of coupling means for permitting a mechanism to mate with the upper end of the band 54 to thereby pull it taut during upward travel of the compaction plate when the door 24 is open.

Figure 4:
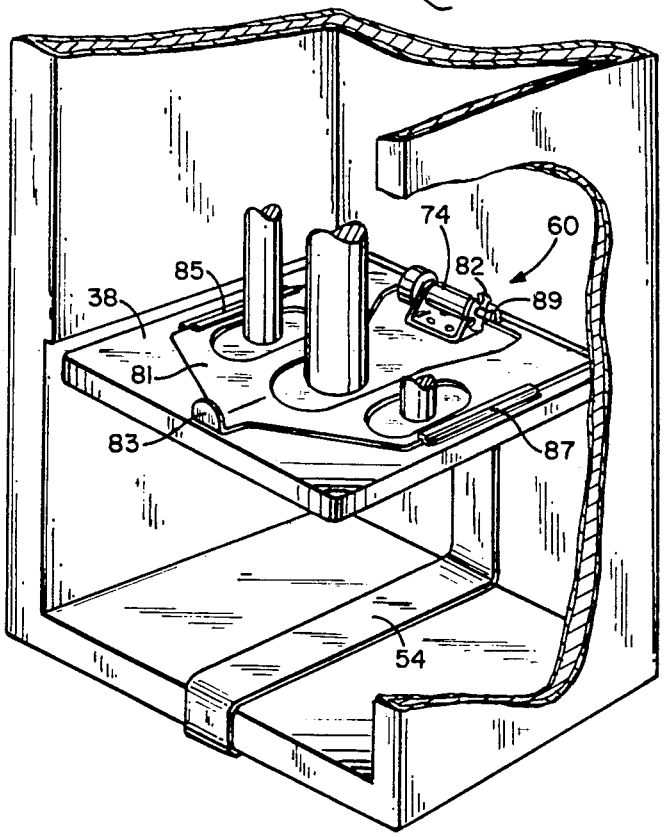
FIG. 4 shows an alternative locking mechanism for the spring reel assembly.

One such alternative is shown in FIG. 4, wherein a lock plate 81 replaces the lock rod 86 previously described. As can be seen from the blown-apart view, mounted on the upper surface of the compaction plate 38 is a take-up reel and lock combination consisting of a take-up reel assembly 60 (as shown in FIG. 2) and a lock plate 81. The lock plate 81 has a hand lever 83, positioned proximate to the door 24, for ease of access. Mounted perpendicularly to the side of the plate lock containing the lever are two guide brackets as at 85 and 87. These are angled at sufficient height above the surface of the compactor plate that they allow the lock plate to side towards the back of the compactor to disengage the reel 60 or slide towards the door to engage it. A projection 89 extends upward from the back lip of the lock plate 81 so that when the hand lever 83 is used to pull the lock plate towards the open door 24, the projection becomes engaged with the lock wheel 82 and thus prohibits release of the ejector belt 54 from the spring take-up reel 76, in the manner described previously.

ALTERNATIVE EMBODIMENT

Figure 5:
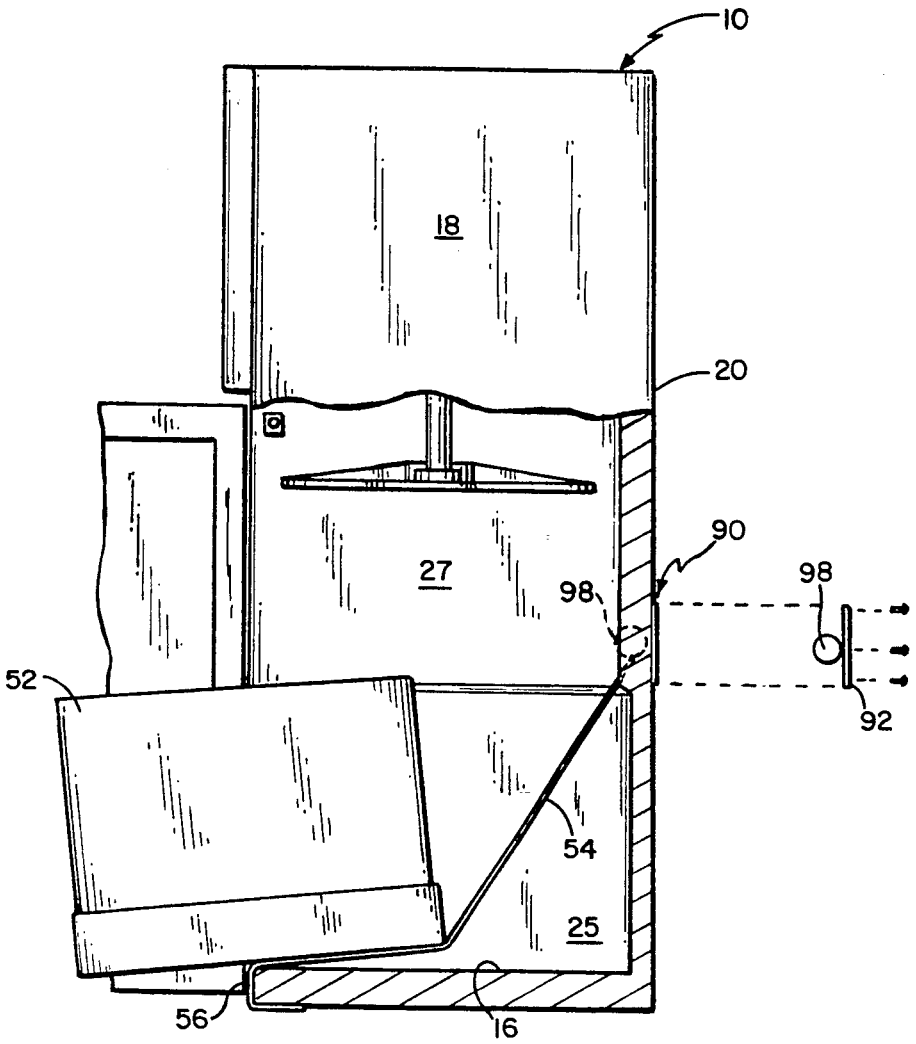
FIG. 5 is a side elevation of an alternative arrangement of a trash compactor with motor driven take up, showing a box of trash being ejected.

Referring to FIG. 5, there is shown the refuse compactor 10 in a side elevation with a portion of the right side wall 18 broken away to reveal the workings of the ejector mechanism. Cut through the rear panel 20 as at 90 is a rectangular opening through which the electric motor-driven reel assembly of FIG. 6 is inserted.

Figure 6:
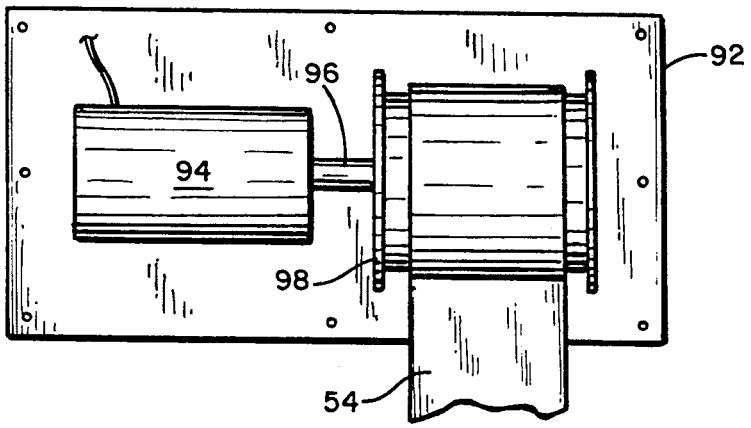
FIG. 6 is a view of an alternative arrangement having a motor-driven reel used in the embodiment of FIG. 5.

As illustrated in FIG. 6, the assembly comprises a metal plate 92 adapted to be attached by screws to the rear panel 20 and appropriately attached to the mounting plate 92 is a small, relatively high torque motor 94 whose output shaft 96 drives a cylindrical reel 98 on which the flexible strap 54 is wound. When the motor 94 is appropriately energized, as by closing a push-button switch, the motor drives the reel 98 in a direction to wind the flexible strap 54 thereon. When the motor is no longer driven, however, the strap 54 may be freely pulled from the reel.

With reference again to FIG. 5, when a box-type receptacle 52 is positioned fully within the compaction chamber 25, the strap 54 will be sandwiched between the floor 16 of the compaction chamber and the bottom of the box 52 and between the rear wall 20 of the compaction compartment and a side wall of the box 52.

With the door to the compaction chamber open, when it is desired to eject a filled cube, the operator depresses a push-button switch (not shown) to energize the motor 94 and drive the reel 98. As the strap 54 winds up upon the reel, it is effectively shortened and causes the filled cube 52 to be lifted and partially rotated as it is ejected through the door opening. At this point, the box or cube can readily be carried away.

When an empty cube is returned to the compaction chamber 25, the motor will no longer be energized and the pull on the strap 54 occasioned by the insertion of the cube causes the reel to unwind and the strap to again assume its initial position in intimate contact with the floor and rear side wall of the compaction chamber.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. In a refuse compaction apparatus of the type including an upright rectangular cabinet having a compaction chamber at the base of said cabinet and having a rear side wall and a compaction plate disposed within said cabinet for vertical, reciprocating displacement and an ejection means for facilitating the removal of compacted refuse from said cabinet, said ejection means including an elongated flexible band, having a first end anchored to the front edge of said base of said cabinet and extending across said base and up said rear side wall of said cabinet to a second end which, when tensioned, causes displacement of the compacted refuse, the improvement comprising:

(a) band take-up means coupled to said second end of said elongated flexible band for reeling and unreeling said band as said compaction plate moves downward and upward, respectively, within said cabinet;

(b) a locking means coupled to said band take-up means for preventing the unreeling of said elongated flexible band upon upward movement of said compaction plate to thereby tension said band to lift and rotate said refuse from said compaction chamber.

2. In a refuse compaction apparatus of the type including an upright rectangular cabinet having a compaction chamber at the base of said cabinet and a compaction plate disposed therein for vertical, reciprocating displacement between a first location above said compaction chamber to a second location within said compaction chamber, said cabinet having a base, a ceiling, a front door panel, a first side wall panel, a second side wall panel, and a rear wall panel defining said compaction chamber and for receiving refuse therein which becomes compacted upon descent of said compaction plate to said second location, and an ejection means for facilitating the removal of said compacted refuse from said cabinet, said ejection means including an elongated flexible band, having a first end anchored to the front edge of said base of said cabinet and extending across said base and up said rear side wall of said cabinet to a second end which, when tensioned, causes displacement of the compacted trash, the improvement comprising:

(a) a spring biased band take-up means coupled to said second end of said elongated flexible band for reeling and unreeling said band upon movement of said compaction plate between said first and second locations; and (b) a locking means coupled to said band take-up means for selectively locking said band take-up means to prevent release of said elongated flexible band, whereby movement of said compaction plate tensions said band to lift and rotate said refuse from said compaction chamber.

3. In a refuse compaction apparatus of the type including an upright rectangular cabinet having a compaction chamber at the base of said cabinet and a compaction plate disposed therein for vertical, reciprocating displacement between a first location above said compaction chamber to a second location within said compaction chamber, said cabinet having a base, a ceiling, a front door panel, a first side wall panel, a second side wall panel, and a rear wall panel, and a removable box disposed within said compaction chamber for receiving refuse therein which becomes compacted upon descent of said compaction plate to said second location, and an ejection means for facilitating the removal of said box of compacted refuse from said cabinet, said ejection means including an elongated flexible band, having a first end anchored to the front edge of said base of said cabinet and extending across said base beneath said box and up said rear side wall of said cabinet to a second end which, when tensioned, causes displacement of the compacted trash, the improvement comprising:

(a) reel means coupled to said second end of said elongated flexible band for selectively winding up and playing out said band upon movement of said compaction plate between said second and first locations; and (b) selectively actuatable locking means for locking said reel means against rotation.

4. In a refuse compaction apparatus of the type including an upright rectangular cabinet having a compaction chamber at the base of said cabinet and a compaction plate disposed therein for vertical, reciprocating displacement between a first location above said compaction chamber to a second location within said compaction chamber, said cabinet having a base, a ceiling, a front door panel, a first side wall panel, a second side wall panel, and a rear wall panel, and a removable box disposed within said compaction chamber for receiving refuse therein which becomes compacted upon descent of said compaction plate to said second location, and an ejection means for facilitating the removal of said box of compacted refuse from said cabinet, said ejection means including an elongated flexible band, having a first end anchored to the front edge of said base of said cabinet and extending across said base beneath said box and up said rear side wall of said cabinet to a second end which, when tensioned, causes displacement of the compacted trash, the improvement comprising:

(a) reel means coupled to said second end of said elongated flexible band and journaled for rotation on said compaction plate, for taking up and playing out said band from said reel as said compaction plate reciprocates; and (b) means for selectively locking said reel means against rotation whereby movement of said compaction plate in an upward direction when said reel is locked will result in said box being displaced within said compaction chamber.

5. The refuse compactor as in any one of claims 1–4 wherein said cabinet includes a door which can be opened and closed relative to a front thereof, said means for selectively locking being operative only when said door is open.

6. The refuse compactor as in any one of claims 1–4 wherein said means for selectively locking comprises a lock wheel coupled to said reel means and a reciprocally movable lock rod member for engaging said lock wheel when said door is open and said compactor plate is traveling upward following a downward compaction stroke.

7. The refuse compactor as in any one of claim 1–4 wherein said flexible band is spring steel.

8. The refuse compactor as in any one of claims 1–4 wherein said band is woven nylon fabric.

9. The refuse compactor as in any one of claims 1–4 wherein said band take-up means comprises:

(a) a shaft means journaled for rotation on said compaction plate for releasably receiving said flexible band means; and (b) take-up reel means releasably secured to said shaft means for releasably winding said flexible band means; and (c) a coil spring operatively coupled between said shaft means and said compaction plate for maintaining a predetermined low tension on said elongated flexible band as said band is wound upon and off said spring take-up reel.

10. In a refuse compaction apparatus of the type including an upright rectangular cabinet having a compaction chamber at the base of said cabinet and having a rear side wall and a compaction plate disposed therein for vertical, reciprocating displacement and an ejection means for facilitating the removal of compacted refuse from said cabinet, said ejection means including an elongated flexible band, having a first end anchored to the front edge of said base of said cabinet and extending across said base and up said rear side wall of said cabinet to a second end which, when tensioned, causes displacement of the compacted trash, the improvement comprising:

(a) an electrically operated band take-up means coupled to said second end of said elongated flexible band for tensioning said band to thereby lift and rotate said refuse from said compaction chamber.

11. In a refuse compaction apparatus of the type including an upright rectangular cabinet having a compaction chamber at the base of said cabinet and a compaction plate disposed therein for vertical, reciprocating displacement between a first location above said compaction chamber to a second location within said compaction chamber, said cabinet having a base, a ceiling, a front door panel, a first side wall panel, a second side wall panel, and a rear wall panel, and a removable box disposed within said compaction chamber for receiving refuse therein which becomes compacted upon descent of said compaction plate to said second location, and an ejection means for facilitating the removal of said box of compacted refuse from said cabinet, said ejection means including an elongated flexible band, having a first end anchored to the front edge of said base of said cabinet and extending across said base beneath said box and up said rear side wall of said cabinet to a second end which, when tensioned, causes displacement of the compacted trash, the improvement comprising:

(a) an electrically operated band take-up means coupled to said second end of said elongated flexible band for tensioning said band to thereby lift and rotate said box from said compaction chamber; and (b) means attached to said second end of said elongated flexible band for coupling said flexible band to said band take-up means.

12. Apparatus as in any one of claims 10 or 11 wherein said electrically operable means comprises motor means coupled in driving relation to a cylindrical reel, said second end of said elongated flexible band being attached to said cylindrical reel.

* * * * *